US005077940A

United States Patent [19]

LaRose, Jr.

[11] Patent Number: 5,077,940

[45] Date of Patent: Jan. 7, 1992

[54] DOOR SECURITY APPARATUS

[76] Inventor: Merlin A. LaRose, Jr., P.O. Box 773, Albany, N.Y. 12201

[21] Appl. No.: 663,685

[22] Filed: Mar. 4, 1991

[51] Int. Cl.[5] ..... E06B 3/00; E05C 19/18

[52] U.S. Cl. ..... 49/503; 49/395; 292/259 R

[58] Field of Search ..... 49/503, 394, 395; 292/288, 259, 218, DIG. 32

[56] References Cited

U.S. PATENT DOCUMENTS 2,130,216 9/1938 Zaninovich ..... 292/259 R
3,209,663 10/1965 Baier ..... 49/395
3,809,417 5/1974 Craig ..... 292/259
4,667,992 5/1987 Roden, Jr. ..... 292/259 R
4,779,910 10/1988 Dameron ..... 292/259 R

*Primary Examiner*—Philip C. Kannan
*Attorney, Agent, or Firm*—Leon Gilden

[57] ABSTRACT

An apparatus wherein a latch bar is mounted to opposed lateral sides of a door framework, wherein the latch bar includes a plurality of leg members, each receivable within an associated yoke to secure and position the latch bar relative to the door, with spaced lateral positioning clips mounted to lateral sides of the door frame for supporting the latch bar in position preventing unauthorized opening of an associated door.

4 Claims, 4 Drawing Sheets

DOOR SECURITY APPARATUS

BACKGROUND OF THE INVENTION

1. Field of the Invention

The field of invention relates to door security devices, and more particularly pertains to a new and improved door security apparatus wherein the same is mounted between opposed lateral sides of a door frame to overlie an associated door preventing its unauthorized opening.

2. Description of the Prior Art

Various security devices have been utilized in the prior art to position and maintain devices relative to doors and frameworks to provide integrity and security to the doors and frameworks to prevent inadvertent opening of the door relative to an associated framework. Such devices may be found in U.S. Pat. No. 4,671,014 to Lack wherein a latch bar is mounted to a respective hinge portion of an associated door and extends in a transverse relationship relative to the door for securement to a boss member at an opposed side of the door.

U.S. Pat. No. 4,792,168 to Kardosh is a door blocking device wherein a telescoping bar is mounted between a framework and a rear portion of one door overlying a second door.

U.S. Pat. No. 4,105,232 to Miels sets forth a latching device to overlie a sliding door to prevent inadvertent opening of the door.

U.S. Pat. No. 4,105,233 to Levi sets forth a window and door lock formed as an abutment bar positioned between a rear edge framework of one door relative to a framework.

As such, it may be appreciated that there continues to be a need for a new and improved security apparatus as set forth by the instant invention which addresses both the problems of ease of use a well as effectiveness in construction and in this respect, the present invention substantially fulfills this need.

SUMMARY OF THE INVENTION

In view of the foregoing disadvantages inherent in the known types of door security deivces now present in the prior art, the present invention provides a door security apparatus wherein the same is arranged for mounting overlying opposed lateral sides of a door frame secured to an associated door to prevent inadvertent or unauthorized opening of the associated door. As such, the general purpose of the present invention, which will be described subsequently in greater detail, is to provide a new and improved door security apparatus which has all the advantages of the prior art door security organizations and none of the disadvantages.

To attain this, the present invention provides an apparatus wherein a latch bar is mounted to opposed lateral sides of a door framework, wherein the latch bar includes a plurality of leg members, each receivable within an associated yoke to secure and position the latch bar relative to the door, with spaced lateral positioning clips mounted to lateral sides of the door frame for supporting the latch bar in position preventing unauthorized opening of an associated door.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved door security apparatus which has all the advantages of the prior art door security devices and none of the disadvantages.

It is another object of the present invention to provide a new and improved door security apparatus which may be easily and efficiently manufactured and marketed.

It is a further object of the present invention to provide a new and improved door security apparatus which is of a durable and reliable construction.

An even further object of the present invention is to provide a new and improved door security apparatus which is susceptible of a low cost of manufacture with regard to both materials and labor, and which accordingly is then susceptible of low prices of sale to the consuming public, thereby making such door security apparatus economically available to the buying public.

Still yet another object of the present invention is to provide a new and improved door security apparatus which provides in the apparatuses and methods of the prior art some of the advantages thereof, while simultaneously overcoming some of the disadvantages normally associated therewith.

Still another object of the present invention is to provide a new and improved door security apparatus wherein the same is mounted to a door and positioned upon laterally opposed clips mounted to lateral sides of the door frame for securement of the door to the associated door frame.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an isometric illustration of a modified security apparatus as utilized by the instant invention.

DESCRIPTION OF THE PREFERRED EMBODIMENT

Figure 1:
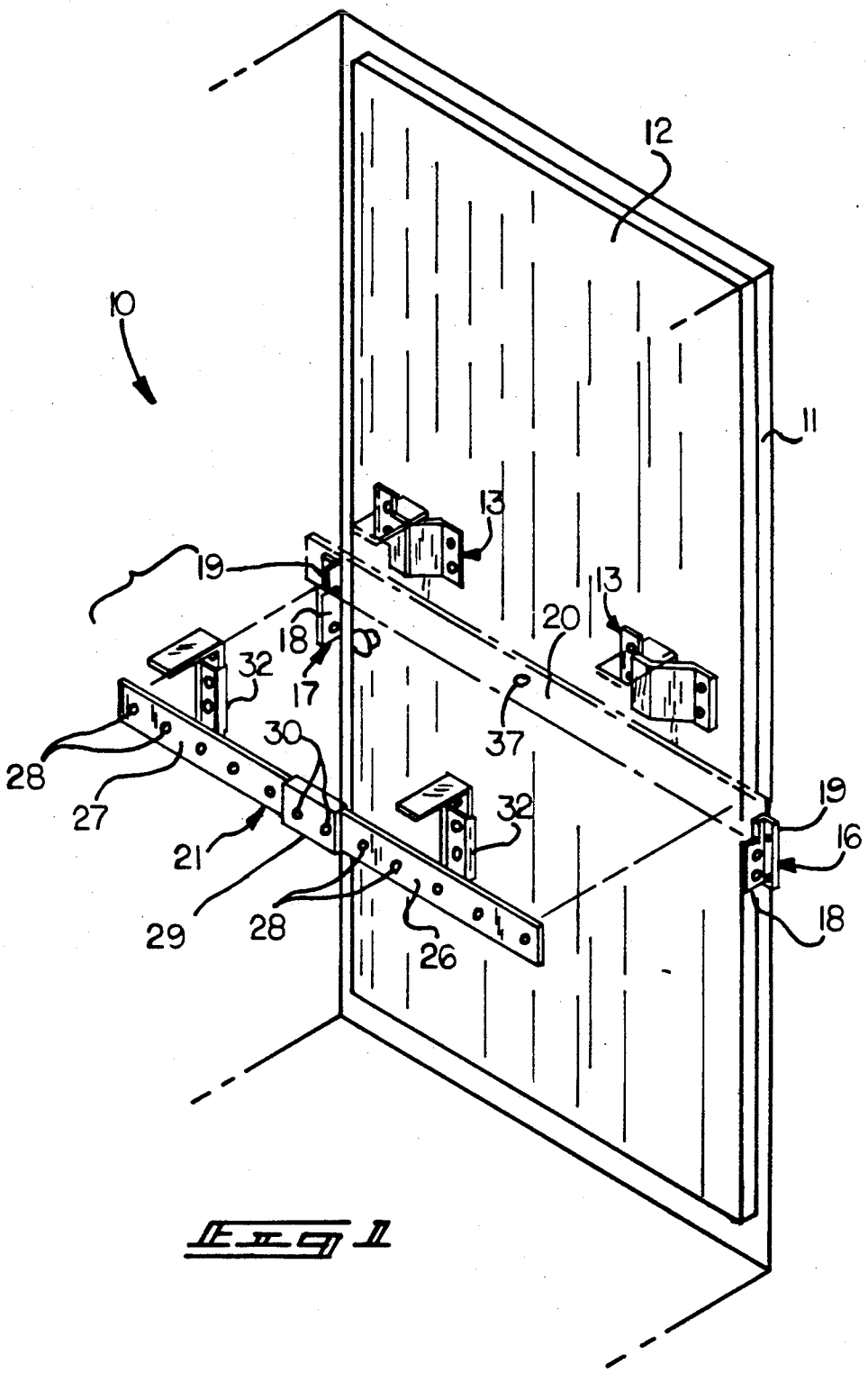
FIG. 1 is an isometric illustration of the instant invention.
Figure 2:
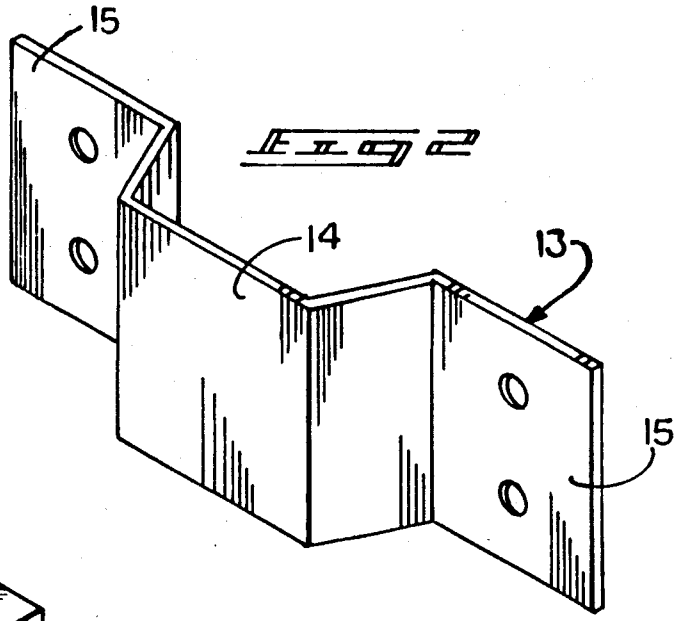
FIG. 2 is an isometric illustration of a yoke member of a plurality of yoke members utilized by the instant invention.

With reference now to the drawings, and in particular to FIGS. 1 to 6 thereof, a new and improved door security apparatus embodying the principles and concepts of the present invention and generally designated by the reference numerals 10 and 10*a* will be described.

Figure 3:
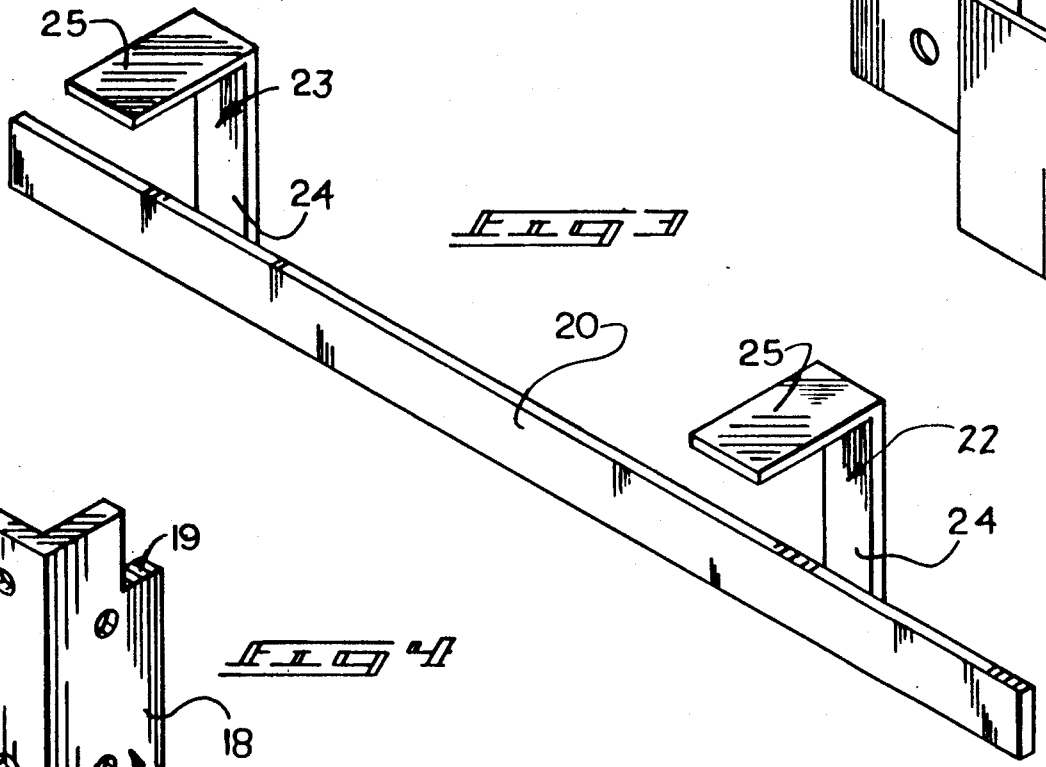
FIG. 3 is an isometric illustration of a unitary latch bar utilized by the instant invention.
Figure 4:
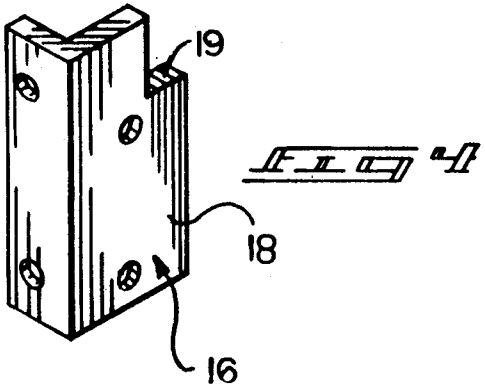
FIG. 4 is an isometric illustration of an "L" shaped positioning clip utilized by the instant invention for mounting to lateral sides of a door frame.
Figure 5A:
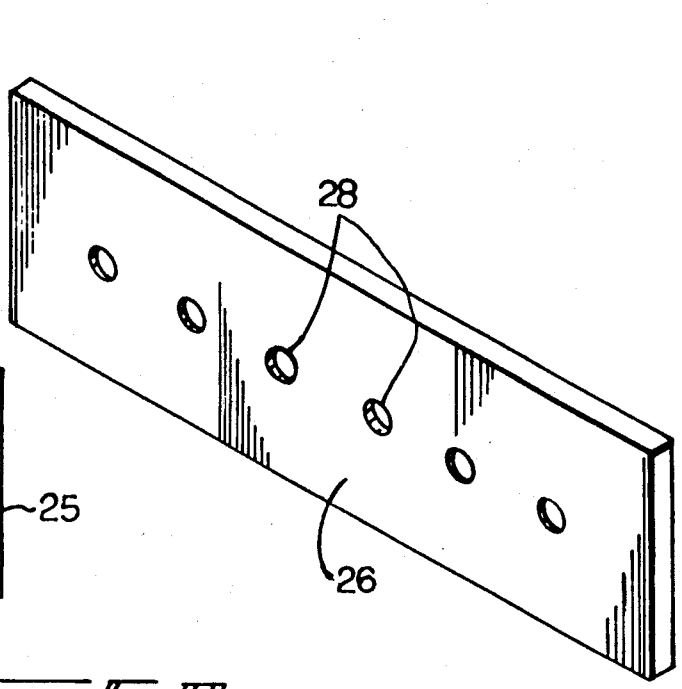
FIG. 5*a* is an isometric illustration of a typical latch bar extension utilized by the instant invention for association with the latch bar sleeve, as illustrated in FIG. 5.
Figure 5B:
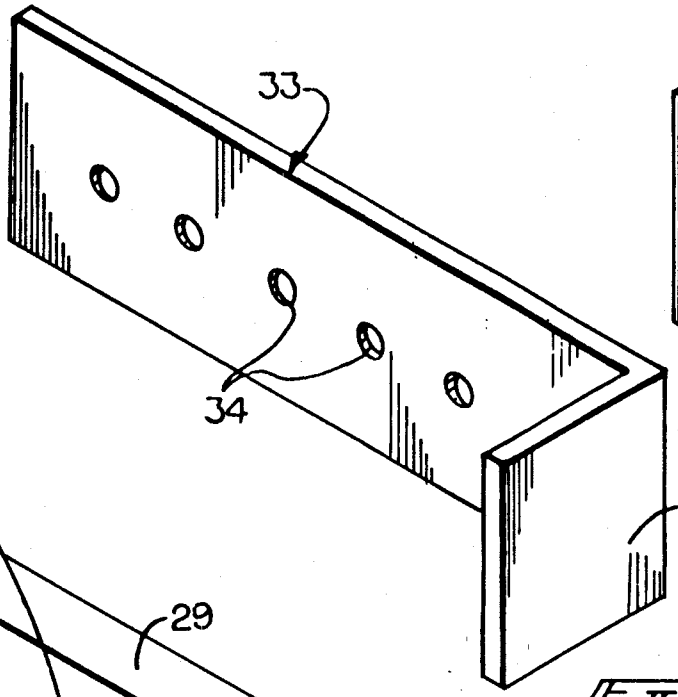
FIG. 5*b* is an isometric illustration of a typical "L" shaped lock bar utilized by the instant invention for securement to the latch bar, as illustrated in FIG. 5*a* and FIG. 1.
Figure 5:
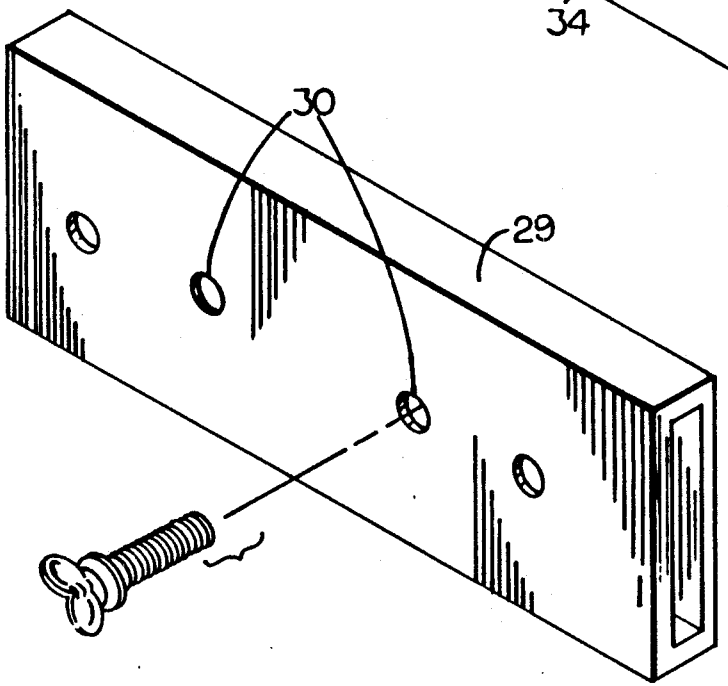
FIG. 5 is an isometric illustration of a latch bar sleeve utilized by the instant invention.
Figure 5:
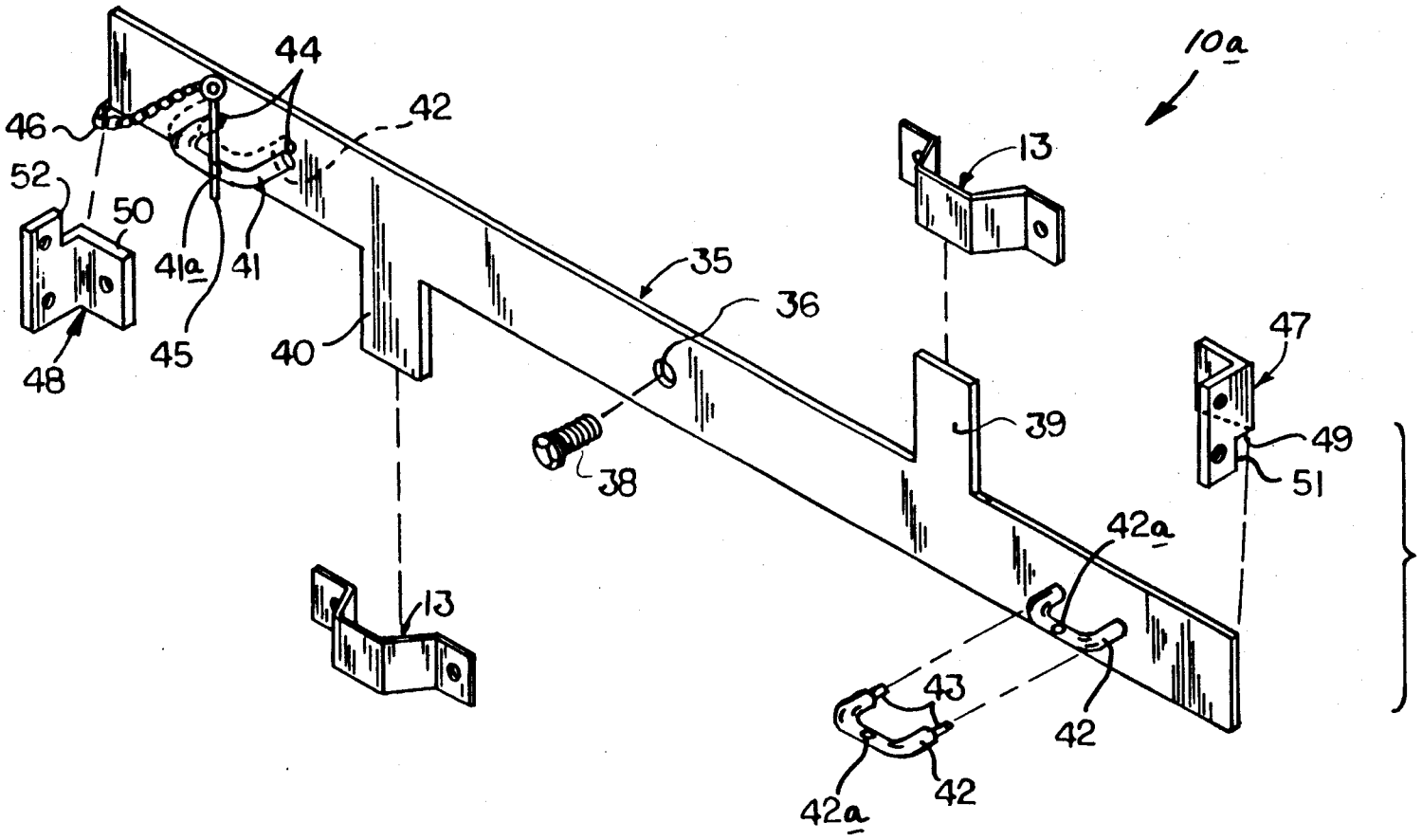

More specifically, the door security apparatus 10 of the instant invention essentially comprises an organization for securement to a door framework 11 that includes parallel side legs for preventing inadvertent opening of a door 12. A plurality of yokes 13 are mounted to an interior surface of the door 12, as illustrated, wherein each of the yokes includes a "U" shaped central portion 15 that defines a receiving column when mounted to the associated door 12 to receive the "L" shaped lock bars that are mounted to the associated latch bar. Each of the "U" shaped central portions 14 includes a plurality of yoke flanges 15 that extend laterally of each central portion and are formed with apertures to receive fasteners for mounting to the interior surface of the door structure, as illustrated in FIG. 1. Right and left respective "L" shaped positioning clips 16 and 17 are mounted to the opposed parallel side legs of the door framework 11 and are each formed with a projecting plate 18 that projects orthogonally relative to each of the side legs of the door framework, and includes a positioning notch 19 that is formed along an exterior edge of each plate 18 spaced remotely from the door to receive the latch bar 21 therewithin. The latch bar 21, as illustrated in FIG. 1, utilizes a rectangular sleeve 29 that includes a plurality of sleeve bores 30 that are through-extending the sleeve and are spaced apart a predetermined spacing. The sleeve 29 receives a plurality of latch bar plates defined by a respective right and left latch bar plate 26 and 27, wherein the latch bar plates 26 and 27 each include a series of aligned, threaded bores 28 that are spaced apart a predetermined spacing. Fastener members 31 are accordingly directed through the sleeve bores 30 and received within the associated threaded bore 28 to provide lateral spacing of the right and left latch bar plates 26 and 27 relative to the sleeve to accommodate doors of various width and effect telescoping of the right and left latch bar plates 26 and 27 within the sleeve 29, as required. Alternatively, a unitary latch bar 20 may be utilized, as illustrated in FIG. 3 for example. The unitary latch bar 20 includes a right and left "L" shaped lock bar 22 and 23 that includes a vertical bar leg 24 and a horizontal bar leg 25, wherein each horizontal bar leg 25 is received within the receiving column defined by a "U" shaped central portion 14 and the associated door 12. Each horizontal bar leg 25 is oriented to overlie the "U" shaped central portion 14 for positioning of the latch bar relative to the door. The right and left positioning clips 16 and 17 enhance mounting of the door to minimize displacement of the latch bar when it is positioned on the positioning clips 16 and 17. The latch bar 21, as illustrated in FIG. 1 for example, utilizes a plurality of lock bar sleeves 32 that are orthogonally mounted to each upper terminal edge of each of the right and left latch bar plates 26 and 27 utilizing a modified "L" shaped lock bar 33 that includes a horizontal bar leg 25, wherein the vertical bar leg includes a plurality of vertical leg internally threaded bores 34, whereupon a fastener member 31 is directed through the associated lock bar sleeve 32 into a desired threaded bore 34 for effecting vertical positioning of each of the "L" shaped lock bars 33 relative to the latch bar 21. It should be noted that each of the bores within the sleeves 29 and 32 are spaced apart a predetermined spacing equal to the predetermined spacing defined by the threaded bores 28 and 34.

FIG. 6 illustrates the use of a modified security apparatus 10*a* that includes a latch bar 35 of a unitary construction, including a top and bottom edge arranged parallel to one another, with a right latch bar leg 39 mounted to the upper edge in an orthogonal relationship, and a left latch bar leg 40 orthogonally mounted to the bottom edge in an orthogonal relationship, with the right and left latch bar legs 39 and 40 spaced apart a predetermined distance in a parallel relationship. The predetermined distance is significant as in the apparatus set forth in FIG. 1, as the yokes 13 are also spaced apart the predetermined distance when mounted to the interior surface of the door 12. A medial bore 36 is positioned medially and orthogonally through the latch bar 35 and received within an internally threaded door bore 37 to permit rotation of the latch bar 35 about the door and reception within the respective yoke 13. To aid in positioning of the latch bar, a right and left "L" shaped latch bar clip 47 and 47 are mounted to each side of the door framework 11 on the parallel legs, wherein each includes a respective lower and upper "L" shaped support surface 49 and 50. The "L" shaped support surfaces 49 and 50 are defined by a thickness equal to a predetermined thickness of the latch bar 35, with a respective vertical right and left abutment flange 51 and 52 projecting above each respective support surface 49 and 50 for positioning of the latch bar when rotated in position. To maintain positioning of the latch bar, once aligned in a horizontal relationship relative to the door framework, a right handle 42 that includes a plurality of leg boss extensions 43 directed longitudinally forwardly of each of the parallel legs of the handle is removed from associated apertures within the latch bar 35 and then repositioned in an overlying relationship relative to a left handle 41, also of a "U" shaped configuration, including parallel side legs. The weighted total of the handles 41 and 42 biases the bar 35 in the latcled position as illustrated. The left handle 41 includes a left handle apertures 41*a* that is aligned with a right handle aperture 42*a* once the left handle is positioned in an overlying relationship coextensively with a right handle 42. It should be noted that the boss extensions 43 are received within leg boss bores 44 that are aligned with and overlie the parallel side legs of the right handle 41. Once the bores 41*a* and 42*a* are aligned, a rigid latch pin 45 mounted to the bar 35 by a securement cable 46 is directed through the pins to secure the handles together and thereby prevent clockwise pivotment of the latch bar 35 about the fastener 38 and maintain positioning of the latch bar in place relative to the door 12.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A door security apparatus in combination with a door framework mounting a door therewithin, the door framework includes parallel side legs mounting the door between the side legs, wherein the apparatus comprises, an elongate, longitudinally aligned latch bar, the latch bar including an upper terminal edge spaced from and parallel a lower terminal edge, and a plurality of "L" shaped lock bars mounted to the upper terminal edge spaced apart a predetermined spacing, wherein the lock bars are arranged parallel relative to one another, and the latch bar includes a central sleeve, the sleeve including a plurality of sleeve bores directed therethrough spaced apart a predetermined spacing, and the latch bar further including a right latch bar plate and a left latch bar plate telescopingly received within opposed ends of the sleeve, each latch bar plate includes a series of threaded latch bar bores spaced apart the predetermined spacing, and a fastener directed through the sleeve and each latch bar plate to secure each latch bar plate to the sleeve, and a plurality of yokes mounted to the door, and each of said yokes spaced apart the predetermined spacing and each of said yokes configured to receive a single lock bar of said plurality of lock bars, and a plurality of "L" shaped positioning clips mounted to the door framework on opposed sides of the door, each clip including a projecting plate projecting orthogonally relative to the door, and each projecting plate including a positioning notch formed along an exterior edge of each plate to receive the latch bar therewithin.

2. An apparatus as set forth in claim 1 wherein each "L" shaped lock bar includes a lock bar sleeve orthogonally mounted to the latch bar, and each sleeve includes a plurality of sleeve openings spaced apart the predetermined spacing, and each "L" shaped lock bar includes a vertical leg, including a plurality of vertical leg threaded bores spaced apart the predetermined spacing, wherein each sleeve receives a fastener through the sleeve into the respective "L" shaped lock bar.

3. A door security apparatus in combination with a door framework, the door framework including spaced parallel side legs and a door mounted within the door framework, the door including an internally threaded door bore, and an elongate, longitudinally aligned latch bar including a medial bore directed medially through the latch bar, and a door fastener directed through the medial bore and received within the door bore to permit pivotment of the latch bar relative to the door, and the latch bar including an upper terminal edge spaced from and parallel a lower terminal edge, the upper terminal edge including a right latch bar leg orthogonally mounted thereto, and the lower terminal end including a left latch bar leg orthogonally mounted thereto, wherein the right and left latch bar legs are spaced apart a predetermined distance, and a right and left yoke mounted to the door spaced apart the predetermined distance, wherein each yoke defines a receiving column between the yoke and the door, wherein the right yoke receives the right latch bar leg and the left yoke receives the left latch bar leg, and a right handle removably mounted adjacent a right terminal edge of the latch bar, and a left handle mounted fixedly to the latch bar adjacent the left terminal edge of the latch bar, and the right handle including a right handle bore and the left handle including a left handle bore, and a plurality of leg boss bores directed through the latch bar adjacent the left handle to receive the right handle, and the right handle including a right handle aperture and the left handle including a left handle aperture, wherein the right and left apertures are coaxially aligned relative to one another when the right handle is positioned and secured in the leg boss bores, and a latch pin positioned through the right and left apertures when the right handle is positioned within the leg boss bores.

4. An apparatus as set forth in claim 3 including a right latch bar clip mounted to the door framework adjacent the right latch bar leg, and a left latch bar clip mounted to the door framework adjacent the left latch bar leg, and the right and left latch bar clips each including an "L" shaped support surface defined by a predetermined width, the predetermined width equal to a further predetermined width defined by the latch bar, and each "L" shaped support surface including a respective right and left abutment flange extending above each respective "L" shaped support surface to secure the latch bar between the respective right and left abutment flanges and the door framework.

* * * * *